US009477184B2

(12) United States Patent
Nishino

(10) Patent No.: US 9,477,184 B2
(45) Date of Patent: Oct. 25, 2016

(54) IMAGE FORMING APPARATUS CONTROLLING TEMPERATURE OF FIXING PORTION IN IMAGE FORMATION MODE AND IN STANDBY MODES

(71) Applicant: CANON KABUSHIKI KAISHA, Tokyo (JP)

(72) Inventor: Yoshiro Nishino, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,489

(22) Filed: May 20, 2015

(65) Prior Publication Data

US 2015/0338801 A1 Nov. 26, 2015

(30) Foreign Application Priority Data

May 21, 2014 (JP) ..... 2014-105127

(51) Int. Cl.
*G03G 15/20* (2006.01)
*G03G 15/00* (2006.01)

(52) U.S. Cl.
CPC ..... *G03G 15/2039* (2013.01); *G03G 15/205* (2013.01); *G03G 15/6591* (2013.01); *G03G 15/65* (2013.01); *G03G 2215/00447* (2013.01)

(58) Field of Classification Search
CPC ..... G03G 15/2046; G03G 15/6588; G03G 15/65; G03G 15/2039; G03G 15/205; G03G 15/6591; G03G 2215/00447
USPC ..... 399/69
See application file for complete search history.

(56) References Cited

U.S. PATENT DOCUMENTS 6,336,010 B1 * 1/2002 Kuwabara ..... G03G 15/2003 399/400
2005/0105924 A1 * 5/2005 Suzuki ..... G03G 15/235 399/45

(Continued)

FOREIGN PATENT DOCUMENTS

JP 2005-321478 11/2005
JP 2010-145907 7/2010

(Continued)

OTHER PUBLICATIONS

English Translation of Kurita, Hiroshi, Image Forming Apparatus. Japanese Patent Office. Nov. 17, 2005. JP2005321478.*

*Primary Examiner* — David Gray
*Assistant Examiner* — Trevor J Bervik
(74) *Attorney, Agent, or Firm* — Fitzpatrick, Cella, Harper & Scinto

(57) ABSTRACT

An image forming apparatus comprising sheet cassettes accommodating different kinds of sheets, respectively; an image forming station for forming images on the sheets fed from the accommodating portions in response to image formation instructions; a heater for heating the images on the sheets; an acquiring portion for acquiring information corresponding to kinds of the sheets; a controller configured to control a target temperature when the heater heats the image on the sheet, on the basis of the information; a selector for selecting one of modes including a first mode in which the target temperatures are set for the kinds of the sheets, respectively and a second mode in which the target temperatures are set commonly to the kinds of the sheets, wherein the controller sets the target temperature of the heater in a stand-by state, at a common temperature, when the selector selects the second mode.

4 Claims, 9 Drawing Sheets

(56) References Cited

U.S. PATENT DOCUMENTS

2008/0175609 A1* 7/2008 Hayashi ..... G03G 15/65
399/45
2010/0119249 A1* 5/2010 Asaka ..... G03G 15/5004
399/70

FOREIGN PATENT DOCUMENTS

JP 2011-112870 6/2011
JP 2013-238825 11/2013

* cited by examiner

Fig. 3A

| | | |
|---|---|---|
| PLAIN | BASIS WEIGHT ($g/m^2$) | 64 ~ 79 |
| | | 80 ~ 105 |
| | | 106 ~ 128 |
| | | 129 ~ 150 |
| | | 151 ~ 180 |
| | | 181 ~ 209 |
| | | 210 ~ 256 |
| | | 257 ~ 300 |
| | | 301 ~ 325 |
| COATED | BASIS WEIGHT ($g/m^2$) | 70 ~ 79 |
| | | 80 ~ 105 |
| | | 106 ~ 128 |
| | | 129 ~ 150 |
| | | 151 ~ 180 |
| | | 181 ~ 209 |
| | | 210 ~ 256 |
| | | 257 ~ 300 |
| | | 301 ~ 325 |

Fig. 3B

| | | |
|---|---|---|
| PLAIN | BASIS WEIGHT ($g/m^2$) | 72 |
| | | 93 |
| | | 117 |
| | | 140 |
| | | 166 |
| | | 195 |
| | | 233 |
| | | 279 |
| | | 313 |
| COATED | BASIS WEIGHT ($g/m^2$) | 75 |
| | | 93 |
| | | 117 |
| | | 140 |
| | | 166 |
| | | 195 |
| | | 233 |
| | | 279 |
| | | 313 |

Fig. 5A

| | F. RLR T. | PLAIN | | | | | | | | | COATED | | | | | | | | |
|---|---|---|---|---|---|---|---|---|---|---|---|---|---|---|---|---|---|---|---|
| | | BASIS WEIGHT (g/m$^2$) | | | | | | | | | BASIS WEIGHT (g/m$^2$) | | | | | | | | |
| | | 64 ~ 79 | 80 ~ 105 | 106 ~ 128 | 129 ~ 150 | 151 ~ 180 | 181 ~ 209 | 210 ~ 256 | 257 ~ 300 | 301 ~ 325 | 70 ~ 79 | 80 ~ 105 | 106 ~ 128 | 129 ~ 150 | 151 ~ 180 | 181 ~ 209 | 210 ~ 256 | 257 ~ 300 | 301 ~ 325 |
| MAX. | 180 | | | | | | | | ● | ● | | | | | | | | ● | ● |
| HIGH | 175 | | | | | | ● | ● | | | | | | | | ● | ● | | |
| MIDDLE | 165 | | | ● | ● | ● | | | | | | | | | ● | | | | |
| M. LOW | 155 | ● | ● | | | | | | | | | | ● | ● | | | | | |
| LOW | 145 | | | | | | | | | | | ● | | | | | | | |
| MIN. | 135 | | | | | | | | | | ● | | | | | | | | |

Fig. 5B

| | F. RLR T. | PLAIN | | | | | | | | | COATED | | | | | | | | |
|---|---|---|---|---|---|---|---|---|---|---|---|---|---|---|---|---|---|---|---|
| | | BASIS WEIGHT (g/m$^2$) | | | | | | | | | BASIS WEIGHT (g/m$^2$) | | | | | | | | |
| | | 72 | 93 | 117 | 140 | 166 | 195 | 233 | 279 | 313 | 75 | 93 | 117 | 140 | 166 | 195 | 233 | 279 | 313 |
| MAX. | 180 | | | | | | | | ● | ● | | | | | | | | ● | ● |
| HIGH | 175 | | | | | | ● | ● | | | | | | | | ● | ● | | |
| MIDDLE | 165 | | | ● | ● | ● | | | | | | | | | ● | | | | |
| M. LOW | 155 | ● | ● | | | | | | | | | | ● | ● | | | | | |
| LOW | 145 | | | | | | | | | | | ● | | | | | | | |
| MIN. | 135 | | | | | | | | | | ● | | | | | | | | |

Fig. 6A

| | F. RLR T. | PLAIN | | | | | | | | | COATED | | | | | | | | |
|---|---|---|---|---|---|---|---|---|---|---|---|---|---|---|---|---|---|---|---|
| | | BASIS WEIGHT (g/m$^2$) | | | | | | | | | BASIS WEIGHT (g/m$^2$) | | | | | | | | |
| | | 64 ~ 79 | 80 ~ 105 | 106 ~ 128 | 129 ~ 150 | 151 ~ 180 | 181 ~ 209 | 210 ~ 256 | 257 ~ 300 | 301 ~ 325 | 70 ~ 79 | 80 ~ 105 | 106 ~ 128 | 129 ~ 150 | 151 ~ 180 | 181 ~ 209 | 210 ~ 256 | 257 ~ 300 | 301 ~ 325 |
| ＊1 | 180 | 170 | 170 | ● | ● | ● | ● | ● | ● | ● | 135 | 155 | 165 | ● | ● | ● | ● | ● | ● |
| ＊2 | 170 | ● | ● | ● | ● | ● | ● | ● | ● | 180 | 135 | 155 | 165 | ● | ● | ● | ● | ● | 180 |
| ＊3 | 165 | ● | ● | ● | ● | ● | ● | ● | 170 | 180 | 135 | 155 | ● | ● | ● | ● | ● | 170 | 180 |
| ＊4 | 155 | ● | ● | ● | ● | ● | ● | 165 | 170 | 180 | 135 | ● | ● | ● | ● | 165 | 165 | 170 | 180 |

＊1 : PRIORITY=THICK
＊2 : STANDARD
＊3 : PRIORITY=THIN
＊4 : PRIORITY=THINNEST

●: NO SWITCHING
NUMERALS : SWITCHING REQUIRED

Fig. 6B

| | F. RLR T. | PLAIN | | | | | | | | | COATED | | | | | | | | |
|---|---|---|---|---|---|---|---|---|---|---|---|---|---|---|---|---|---|---|---|
| | | BASIS WEIGHT (g/m$^2$) | | | | | | | | | BASIS WEIGHT (g/m$^2$) | | | | | | | | |
| | | 72 | 93 | 117 | 140 | 166 | 195 | 233 | 279 | 313 | 75 | 93 | 117 | 140 | 166 | 195 | 233 | 279 | 313 |
| ＊1 | 180 | 170 | 170 | ● | ● | ● | ● | ● | ● | ● | 135 | 155 | 165 | ● | ● | ● | ● | ● | ● |
| ＊2 | 170 | ● | ● | ● | ● | ● | ● | ● | | 180 | 135 | 155 | 165 | ● | ● | ● | ● | ● | 180 |
| ＊3 | 165 | ● | ● | ● | ● | ● | ● | ● | 170 | 180 | 135 | 155 | ● | ● | ● | ● | ● | 170 | 180 |
| ＊4 | 155 | ● | ● | ● | ● | ● | ● | 165 | 170 | 180 | 135 | ● | ● | ● | ● | 165 | 165 | 170 | 180 |

＊1 : PRIORITY=THICK ＊2 : STANDARD
＊3 : PRIORITY=THIN ＊4 : PRIORITY=THINNEST

●: NO SWITCHING
NUMERALS : SWITCHING REQUIRED

IMAGE FORMING APPARATUS CONTROLLING TEMPERATURE OF FIXING PORTION IN IMAGE FORMATION MODE AND IN STANDBY MODES

FIELD OF THE INVENTION AND RELATED ART

The present invention relates to an image forming apparatus such as a copying machine, a printer, and a facsimile machine that use an electrophotographic image forming method, or an electrophotographic recording method. It relates also a multifunction image forming apparatus which is capable of performing two or more functions of the preceding examples of image forming apparatus.

Heretofore, an image forming apparatus is provided with a fixing device which fixes a toner image formed on a sheet of recording medium to the sheet, by applying heat and pressure to the toner image. This type of fixing device is desired to be changed in fixation temperature according to the type of sheet which is subjected to a fixing process. However, in order to change a fixing device in fixation temperature, a certain amount of time is required. In the case of the image forming apparatus disclosed in Japanese Laid-open Patent Application 2005-321478, a mode in which the fixing device is changed in fixation temperature according to the sheet type to prioritize image quality, and a mode in which even in the case where two or more types of recording mediums are used in a given image forming operation, the fixing device is not changed in fixation temperature to prioritize productivity, are selectively used. To describe in detail, in a case where the image forming apparatus disclosed in Japanese Laid-open Patent Application 2005-321478 is used in the mode in which productivity is prioritized, a temperature level which is acceptable as the fixation temperature for two or more types of recording mediums is determined, and all the recording mediums which are different in optimal fixation temperature are processed for image fixation, with the target temperature of the fixing device set to the determined temperature level. However, in the case of an image forming apparatus structured so that its fixation temperature is set based on the two or more types of recording mediums which are to be processed for image fixation, the fixation temperature cannot be set until the contents of an image formation process is determined. Therefore, it is rather difficult to preheat the fixing device while the contents of the image formation process are determined. For example, if the image forming apparatus sets the standby temperature for the fixing device, that is, the temperature at which the fixing device is heated during a standby period in which the contents of the image formation process are determined, without taking the fixation temperature into consideration, a certain amount of difference occurs between the standby temperature and fixation temperature. More concretely, in a case where the standby temperature for the fixing device is lower than the fixation temperature for the fixing device, the image forming apparatus is required to provide the fixing device with an additional amount of heat as an image forming operation begins, whereas in a case the standby temperature for the fixing device is higher than the fixation temperature of the fixing device, the image forming apparatus is required to cool the fixing device as an image forming operation begins. Further, it takes a substantial length of time to change the fixing device in temperature. Therefore, if a substantial amount of difference occurs between the standby temperature for the fixing device and the fixation temperature of the fixing device, the image forming apparatus has to be idled for a substantial length of time until it becomes possible for the fixing device to process recording medium for image fixation.

SUMMARY OF THE INVENTION

The primary object of the present invention is to minimize the length of time it takes for an image forming apparatus, which is being kept on standby, to becomes ready for image fixation.

According to an aspect of the present invention, there is provided an image forming apparatus comprising a plurality of accommodating portions configured to accommodate respective sheets different from each other; an image forming station configured to form images on the sheets fed from said accommodating portions in response to image formation instructions; a heating portion configured to heat the images formed on the sheets by said image forming station; an acquiring portion configured to acquire information corresponding to kinds of the sheets accommodated in said accommodating portion; a controller configured to control a target temperature when said heating portion heats the image on the sheet, on the basis of the information; a selector configured to select one mode from modes including a first mode in which the target temperatures are set for the kinds of the sheets accommodated in said accommodating portions, respectively and a second mode in which the target temperatures are set commonly to the kinds of the sheets accommodated in the accommodating portions, wherein said controller sets the target temperature of said heating portion in a stand-by state waiting for the image formation instructions, at a common temperature, when said selector selects the second mode.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 3A is a table which shows the relationship between the recording medium type and basis weight range of recording medium, and FIG. 3B is a table which shows the relationship between the recording medium type and the representative value of the basis weight range of the recording medium.

FIG. 5A is a table which shows the recording medium type based on basis weight range, and the heating condition in the first mode in the preferred embodiment, and FIG. 5B is a table which shows the relationship between the recording medium type based on the representative value of the basis weight range, and the heating condition in the first mode in the preferred embodiment.

FIG. 6A is a table which shows the recording medium type based on basis weight range, and the heating condition in the second mode in the preferred embodiment, and FIG. 6B is a table which shows the relationship between the recording medium type based on the representative value of the basis weight range, and the heating condition in the second mode in the preferred embodiment.

DESCRIPTION OF THE EMBODIMENTS

Figure 1:
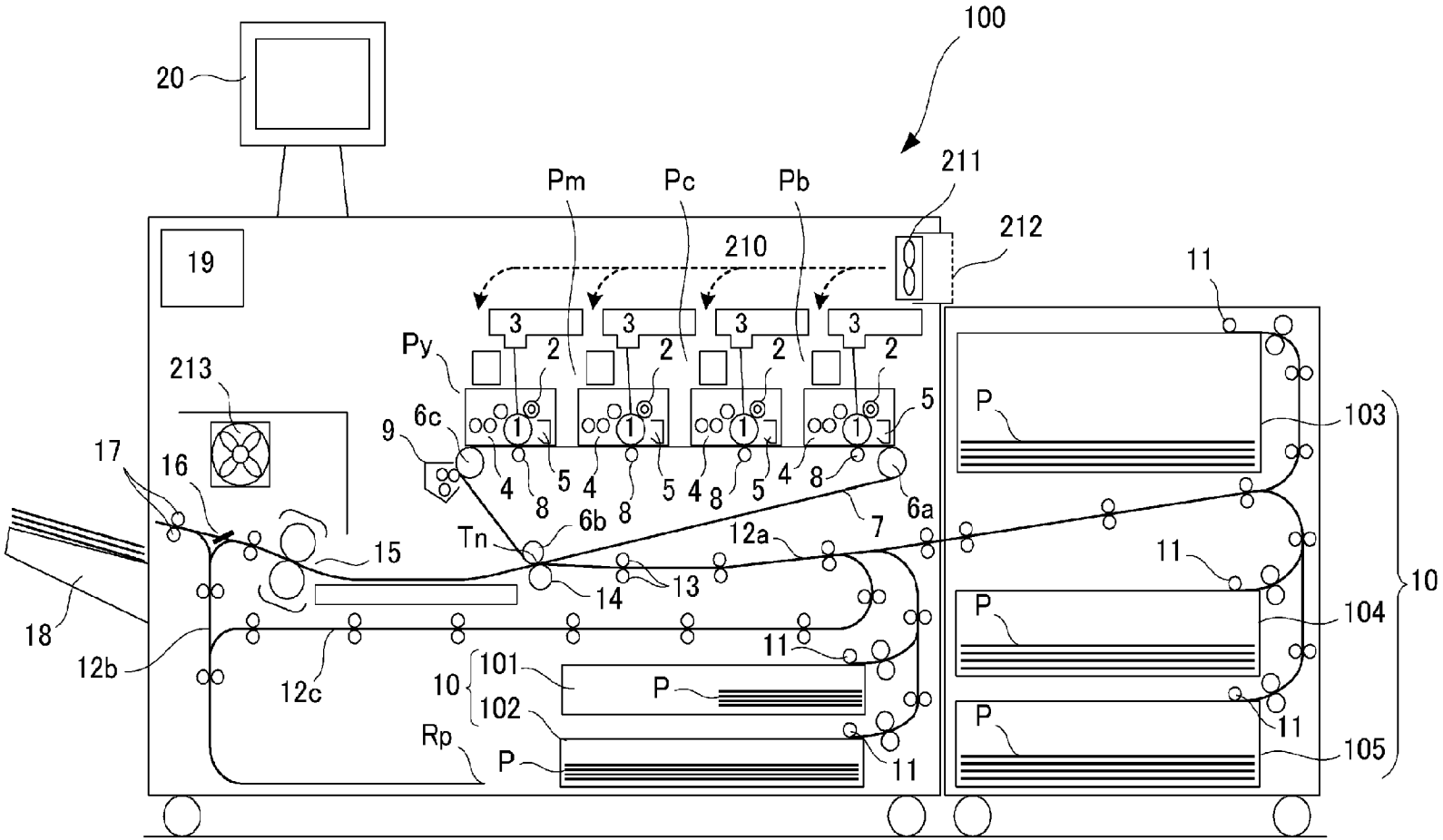
FIG. 1 is a drawing which shows the structure of the image forming apparatus in one of the preferred embodiment of the present invention.
Figure 2:
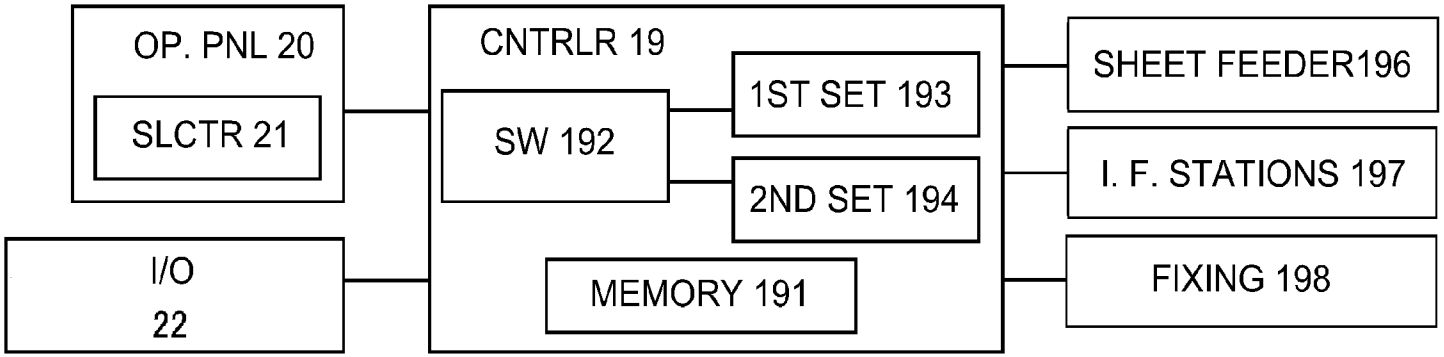
FIG. 2 is a block diagram of the control system of the image forming apparatus in the preferred embodiment.

Hereinafter, the present invention is concretely described with reference to one of the preferred embodiments of the present invention. The image forming apparatus in this embodiment is an electrophotographic full-color laser printer 100 (which hereafter will be referred to simply as printer 100). FIG. 1 is a drawing which shows the structure of the printer 100. FIG. 2 is a block diagram of the control system of the printer 100.

By the way, this embodiment is not intended to limit the present invention in terms of the structure of an image forming apparatus. That is, the present invention is also applicable to various image forming apparatuses which are different in structure, material, measurement, etc, from the one in this embodiment.

Embodiment

Image Formation Section

The printer 100 in this embodiment executes various controls with the use of a control circuit 19 as a controlling means. The control circuit 19 is provided with a computing section 190 such as CPU 20, a storing section 191 (memory), such as ROM and RAM, as a storing means (FIG. 2). In the storing section 191, various programs are stored. The computing section 190 performs various functions by reading the various programs in the storing section 190. Further, the control circuit 19 is in connection to the external interface 22 of a host computer or the like. A print command signal (image formation job execution command) is inputted into the control circuit 19 through the external interface 22. As a print command signal (image formation job) in inputted into the control circuit 19, the control circuit 19 carries out an image forming operation following one of the image formation controls sequences stored in the storing section 191.

As the image forming operation is carried out, a toner image is formed through image formation processes, more concretely, charging, exposing, developing, and transferring processes. In this embodiment, the first, second, third, and fourth image forming sections Py, Pm, Pc and Pb, respectively, are aligned in tandem in the main assembly of the printer 100, and form yellow, magenta, cyan and black toner images, respectively.

Next, the toner image formation in each of the image forming sections Py, Pm, Pc and Pb is described with reference to the image forming section Py. In the image forming section Py, a photosensitive drum 1 as an image bearing member is rotated at a preset peripheral velocity (process speed). The peripheral surface of the photosensitive drum 1 is uniformly charged to preset polarity and potential level by a charging device 2. Then, the charged peripheral surface of the photosensitive drum 1 is exposed to (scanned by) a beam of laser light emitted by an exposing device 3 while being modulated with signals generated by the image formation job. As a result, an electrostatic latent image, which reflects the image information, is formed on the charged peripheral surface of the photosensitive drum 1. Then, this latent image is developed with yellow toner (developer) which a developing device 4 uses. Consequently, a yellow toner image is formed on the peripheral surface of the photosensitive drum 1.

Similarly, magenta, cyan and black toner images are formed in the image forming sections Pm, Pc and Pb, respectively.

Further, in this embodiment, an intermediary transfer belt 7 is disposed in the main assembly of the printer 100, in such a manner that it extends from the image forming section Py to image forming section Pb, in contact with the image forming sections Py, Pm, Pc and Pb. To describe in detail, the intermediary transfer belt 7 is suspended by a combination of a driver roller 6*a*, an idler roller 6*b*, and a tension roller 6*c*, in a manner to bridge the adjacent two rollers. It is rotated by the driver roller 6*a* at a peripheral velocity which corresponds to the peripheral velocity of the photosensitive drum 1.

The toner images which are formed, on the peripheral surface of the photosensitive drum 1, in the image forming sections, and which are different in color, are sequentially transferred in layers onto the outward surface of the intermediary transfer belt 7 by the primary transfer roller 8 (transferring member).

Consequently, a full-color toner image is effected on the surface of the intermediary transfer belt 7. After the transfer of the toner image from the photosensitive drum 1, the transfer residual toner, that is, the toner remaining on the peripheral surface of the photosensitive drum 1 after the transfer, is removed by a drum cleaner 5, so that the peripheral surface of the photosensitive drum 1 can be used for the next image formation.

Meanwhile, sheets P (for example, sheets of ordinary paper, cardstock, OHP film, and the like) are conveyed one by one from a sheet feeding section 10 to a pair of registration rollers 13 through a recording medium conveyance passage 12*a*, by a sheet feeder roller 11. Then, each sheet P is conveyed by the pair of registration rollers 13 to the secondary transfer nip Tn which is between the intermediary transfer belt 7 and secondary transfer roller 14, and then, is conveyed through the secondary transfer nip Tn remaining pinched by the intermediary transfer belt 7 and secondary transfer roller 14. While the sheet P is conveyed through the secondary transfer nip Tn, the toner image on the surface of the intermediary transfer belt 7 is transferred onto the sheet P by the secondary transfer roller 14. After the transfer of the toner image, the transfer residual toner, that is, the toner remaining on the surface of the intermediary transfer belt 7, is removed by a belt cleaner 9, becoming ready for the next image transfer. In this embodiment, the combination of the image forming sections Py, Pm, Pc and Pb, intermediary transfer belt 7, and secondary transfer roller 14 functions as an image forming means for forming a toner image on the sheet P.

The sheet P on which an unfixed toner image is present is guided into the nip of the fixing device 15 as a fixing means, with its image bearing surface facing upward. Then, the sheet P is conveyed through the nip of the fixing device 15, remaining pinched by the fixing means of the fixing device 15. Thus, the toner image on the sheet P is thermally fixed to the surface of the sheet P. In a case where an image is formed on only one of the two surfaces of the sheet P, as the sheet P is discharged from the fixing device 15, it is guided by a switching flapper 16 toward a pair of discharge rollers 17, and then, is discharged into a delivery tray 18 attached to one of the side walls of the main assembly of the printer 100.

In a case where an image is formed on both of the two surfaces of the sheet P, as the sheet P is discharged from the fixing device 15, it is guided downward by the switching flapper 16 into a reverse conveyance passage 12*b*. In the reverse conveyance passage 12*b*, as the leading edge of the sheet P reaches a reversal point Rp, the sheet P is reversed in conveyance direction so that the sheet P is conveyed toward a conveyance passage 12*c* for the two-sided printing, with its image bearing surface facing upward. Then, the sheet P is conveyed to the pair of registration rollers 13 through the sheet conveyance passage 12*a*, and is conveyed to the secondary transfer nip Tn by the pair of registration rollers 13. Then, the sheet P is conveyed through the secondary transfer nip Tn, remaining pinched by the intermediary transfer belt 7 and secondary transfer roller 14. As the sheet P is conveyed through the secondary transfer nip Tn, the toner on the surface of the intermediary transfer belt 7 is transferred onto the sheet P. Then, the sheet P is guided into the fixing device 15, in such an attitude that the surface of the sheet P, on which an unfixed toner image is present, faces upward. Then, the sheet P is conveyed through the secondary transfer nip Tn remaining pinched by the fixing means of the fixing device 15. While the sheet P is conveyed through the secondary transfer nip Tn, the toner image is thermally fixed to the sheet P. After the sheet P is discharged from the fixing device 15, it is guided by the switching flapper 16 toward the pair of discharge rollers 17, and is discharged into the delivery tray 18.

The top portion of the main assembly of the printer 100 is provided with an air intake opening 212, through which cooling air is guided into the image forming sections Py, Pm, Pc and Pb in the direction indicated by an arrow mark 21, by an air intake fan 211. The cooling air cools the image forming sections Py, Pm, Pc and Pb, and also, cools the intermediary transfer belt 7, belt cleaner 9, etc. Then, it cools the fixing device 15. Thereafter, it is discharged from the main assembly of the printer 100, through an exhaust opening, by an exhaust fan 213.

In this embodiment, the sheet feeding section 10, which functions also as sheet storage section, is equipped with cassettes 101-105, which are different in the type of the sheet which they can store. That is, the cassettes 101-105 are different in the recording medium type which can store, although some of them may be made the same in the recording medium type. For example, sheets of recording medium may be stored in the sheet feeding section 10 in such a manner that the cassettes 101-105 become different in sheet size or sheet type (ordinary paper, coated paper, cardstock, etc.), or in such a manner that two of the five cassettes are the same in sheet size or sheet type, and the rest are different in sheet size or sheet type. That is, the printer 100 in this embodiment can carry out such an image forming operation that is switched in recording medium (sheet) choice in the middle of the operation.

Here, an "image formation job" means an operational sequence which is started by a print command signal (image formation command signal). It comprises a step in which a preparatory operation (so-called pre-rotation) necessary for image formation, a step in which an image is formed, and another preparatory operation (so-called post-rotation) which is necessary to end the image forming operation. More concretely, it means the operational sequence which comprises the pre-rotation (preparatory operation for image formation) which follows the reception of a print command signal (inputting of image formation job), image forming operation, and post-rotation (operation after image formation), including image formation period, sheet intervals (paper intervals, period in which no image is formed). For example, in a case where the electric power source of the printer 100 is on; the printer 100 is on standby (in standby mode); and an image formation job is yet to be inputted, a combination of the pre-rotation step, image formation step in which images are formed on 10 sheets of ordinary paper and two sheets of cardstock, and post-rotation step, makes up a single image formation job. However, in a case where two or more jobs are inputted in succession, or the second job is inputted while the first image formation job is carried out, the pre-rotation step and post-rotation step may be skipped. For example, in a case where an image formation command for the first image formation job which is for forming images on 10 sheets of ordinary paper and two sheets of cardstock, and an image formation command for the second image formation job which is for forming images on five sheets of coated paper, are inputted while the printer 100 is on standby, at least one of the post-rotation of the first image formation job and the pre-rotation of the second image formation job may be skipped.

As soon as the image formation job is completed, the image forming apparatus 100 is placed in the standby mode in which it waits for the inputting of the next print command, in order to enable the apparatus 100 to start the next image formation job as soon as possible. That is, as soon as the current image formation job (image formation mode) is ended, the image forming apparatus 100 is placed in the standby mode, and is kept in the standby mode until the inputting of the next image formation job. The switching of the operation mode from the image formation mode into the standby mode is carried out by the control circuit 19 which controls various devices of the image forming apparatus 100. By the way, the image forming apparatus 100 may be configured so that after the apparatus 100 is kept in the standby mode for a preset length of time, it is switched in operation mode from the standby mode to the low power consumption mode (so-called sleep mode) which is lower in electric power consumption than the standby mode.

FIG. 2 is a block diagram of the control system of the printer 100 in this embodiment. The control circuit 19 is such a control circuit that is enabled to control the entirety of the printer 100. The control circuit 19 is in connection to the sheet conveying section 196 (sheet feeding section), image forming section 197, and fixing section 198, and is in control of the operation of these sections. The sheet conveying section 196 has a motor for driving each of the rollers for conveying a sheet P of recording medium, sensors, etc. The image forming section 197 has a motor for driving the photosensitive drum 1, etc., for forming a toner image, power sources for the charging, developing, and transferring devices, exposing device 3, sensors, etc. The fixing section 198 has a motor for driving the fixing device 15, electric power source for supplying the heater with electric power, sensor, etc. Further, the control circuit 19 controls the various motors, electric power sources, etc., based on the information inputted into the control circuit 19 from these sensors. Further, the control circuit 19 is in connection to a control panel 20 with which the main assembly of the printer 100 is provided, external interface 22, etc. Thus, an operator can input various settings into the printer 100 through the control panel 20, or external interface 22. The control panel 20 is an information input interface which can be operated by a user as an operator.

The parts of the functions of the control circuit 19 which controls the printer 100 are to function as the switching section 192, first setting section 193, and second setting section 194. To describe in detail, the control circuit 19 functions as the switching section, first setting section, and second setting section, by reading the programs stored in the storing section 191 with its computing section 190, and carrying out the programs.

The switching section 192 is a mode switching means (setting means) for switching (selectively setting) between the first and second modes which will be described later. The first setting section 193 sets the heating condition for the fixing device 15 based on the first mode, in a case where the operational mode for the fixing device is in the first mode (first mode is selected). If the operational mode is switched to the second mode, the second setting section 193 sets (controls) the heating condition for the fixing device 15, based on the second mode.

In the storing section 192, the relationships between the sheet type, and the heating condition (heating temperature) for the fixing device 15, are stored for each of the first and second modes. Therefore, the first setting section 193 and control circuit 19 properly set the heating condition which is in accordance with the type of the sheet P which is used for the image formation job, based on the relationship between the sheet type and heating condition, which are stored in the storing section 191.

FIG. 3A is a table which shows the relationship between the sheet type and the basis weight ranges of the sheet. FIG. 3B is a table which shows the relationship between the sheet type and the representative value of the basis weight range of the sheet. The information regarding the types (types, basis weight) of the sheets P stored in the cassettes 101-105 is set in advance by a user through the control panel 20, external interfaces 22, etc. The set information is stored in the storing section 191. It is based on this information that the control circuit 19 causes the printer 100 to form images, convey sheets, fix images, and perform the like operation, under the condition which is suitable for the sheet P. That is, the control circuit 19 as an obtaining means obtains the information regarding the type of the sheet P stored in the cassettes 101-105, and carries out various control sequences based on the obtained information. Regarding the setting of the sheet type, there are available such tables as FIG. 3A, which shows the relationship among sheet type (ordinary papers or coated papers), basis weight, and temperature range, and FIG. 3B which shows the relationship among sheet type, basis weight, and representative temperature values. By the way, in FIGS. 3A and 3B, in terms of sheet type, sheets are classified as ordinary paper and coated paper. However, sheets may be classified into other types than those in this embodiment. For example, recording medium may be classified as recycled paper, embossed paper, film, label paper, etc.

[Fixing Device]

Figure 4:
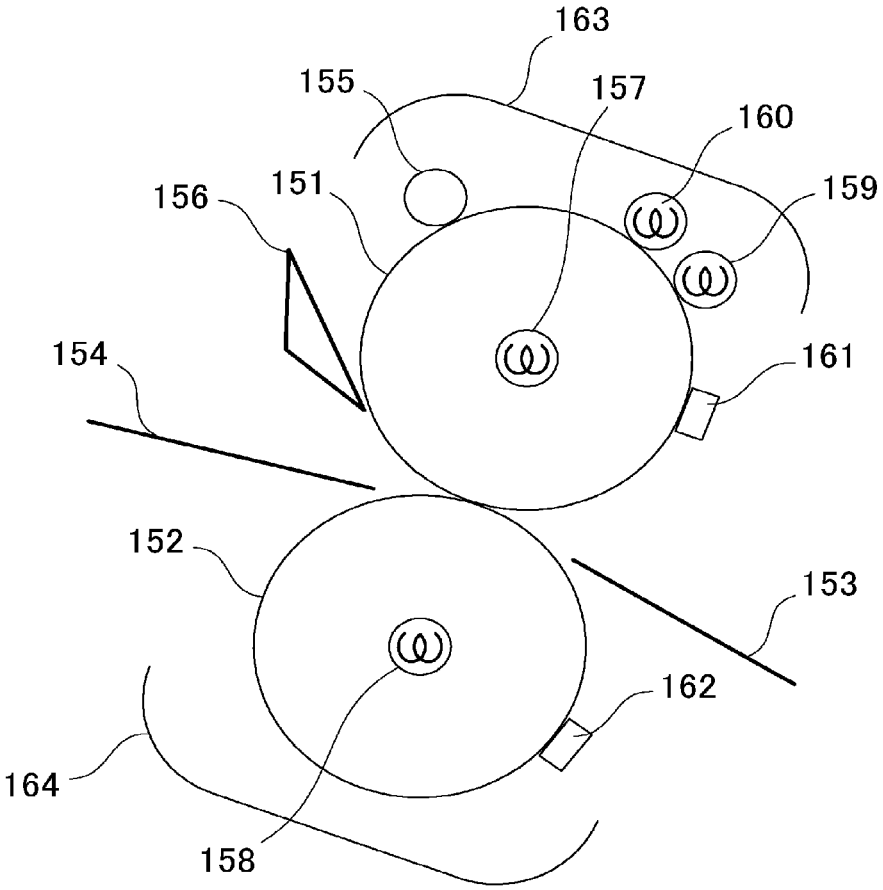
FIG. 4 is a drawing which shows the structure of the fixing device in the preferred embodiment.

Next, referring to FIG. 4, the fixing device 15 is described in greater detail. FIG. 4 is a drawing for showing the structure of the fixing device 15.

As a sheet P of paper is conveyed out of the secondary transfer nip Tn, it is guided along the entrance guide 153 of the fixing device 15, into the nip formed between the fixation roller 151 as a heating member, and the pressure roller 152, and is subjected to the thermal fixation process in the nip. As the sheet is conveyed out of the nip, it is conveyed between the exit guide 154 of the fixing device 15, and the separation guide 156 of the fixing device 15. Then, it is conveyed to the sheet discharging section, or the sheet conveyance passage for the two-sided printing operation.

The fixation roller 151 in this embodiment is heated by main heater 157 as an internal heat source, and a pair of external heat rollers 159 and 160. On the peripheral surface of the fixation roller 151, a temperature sensor 161, as a temperature detection unit, is provided to detect the surface temperature of the fixation roller 151. The temperature sensor 161 sends its output signal which is proportional to the detected temperature, to the control circuit 19. The control circuit 19 controls the electric power supply to the main heater 157 and external heat rollers 159 and 160, based on the output from the temperature sensor 161, in such a manner that the temperature of the fixation roller 151 remains at a target temperature. That is, in a case where it is necessary to reduce the amount by which the fixation roller 151 is supplied with heat, the control circuit 19 reduces the amount by which electric power is supplied to the main heater 157 (internal heater) and external heat rollers 159 and 160, whereas in a case where it is necessary to increase the amount by which the fixation roller 151 is supplied with heat, the control circuit 19 increases the amount by which electric power is supplied to the main heater 157 (internal heater) and external heat rollers 159 and 160. In this case, a combination of the control circuit 19, main heater 157, and external heat rollers 159 and 160 functions as a heating means, which heats the fixation roller 151 by an amount which is in proportion to the output of the temperature sensor 161. There is disposed a cleaning roller 155 on the downstream side of the fixation roller 151 in terms of the direction in which the fixation roller 151 rotates in the nip. The cleaning roller 155 removes the contaminants such as the toner, etc., which are remaining adhered to the peripheral surface of the fixation roller 151.

The pressure roller 152 is such a roller that works in conjunction with the fixation roller 151 to form a nip between itself and fixation roller 151. There is disposed a pressure roller heater 158 in the hollow of the pressure roller 152, to heat the pressure roller 152. There is also disposed a temperature sensor 162, as a temperature detecting means, on the peripheral surface of the pressure roller 152. The temperature sensor 162 sends its output which is proportional to the detected temperature, to the control circuit 19.

The control circuit 19 controls the amount by which electric power is supplied to the pressure roller 152, based on the output of the temperature sensor 162 so that the temperature of the pressure roller 152 remains at a target level. Further, the pressure roller 152 is kept pressed on the fixation roller 151 by a preset amount of pressure generated by compression springs (unshown).

In the case of the fixing device 15 in this embodiment, the heating condition (heating temperature, target temperature) for the fixing device 15 is controlled by controlling primarily the temperature condition of the fixation roller 151. However, the heating condition (heating temperature) of the fixing device 15 may be controlled in consideration of the temperature condition of the pressure roller 152. In such a case, the pressure roller heater 158 is added as a heating means, which heats the pressure roller 152 based on the output of the temperature sensor 162.

[Operational Mode]

Next, the operational modes of the printer 100 in this embodiment are described. The printer 100 in this embodiment is capable of forming images on two or more types of recording medium in a single image forming operation. That is, it is enabled to operate in two operational modes (first and second modes), which are selectable through the mode selection section 21 of the control panel 20, or the external interface 22. The first mode is such an operation mode that the fixing device 15 is switched in heating condition according to each of the two or more sheet types. That is, in the first mode, the heating condition for the fixing device 15 is set according to the type of the sheets P stored in the cassettes 101-105. The second mode is such an operation mode that in order to minimize the frequency with which the fixing device 15 is switched in heating condition, the sheets P which are different in type are processed under the commonly acceptable heating condition as much as possible. That is, in a case where two or more types of sheets in the cassettes 101-105 may be heated under a common heating condition, the heating condition for the fixing device 15 is set to the common heating condition.

In the first mode, the optimal heating condition is set for each of the sets of sheets P which are different in type, and therefore, it is possible to output images higher in quality than in the second mode. That is, in the first mode, it is possible to minimize the difference among the sheet types, in terms of the gloss of a finished print. That is, the first mode is such an operational mode that is advantageous in terms of image quality. On the other hand, in a case where an image forming operation in which two or more types of sheets are used is carried out in the first mode, the fixing device 15 is changed in heating condition every time the sheet P is changed in type. Thus, the first mode is inferior to the second mode in terms of productivity, because a waiting period is required each time the fixing device 15 is switched in heating condition.

In comparison, in the second mode, two or more types of sheets are heated under the same (common) temperature condition, unlike in the first mode. Thus, the second mode can minimize the frequency with which the fixing device 15 is switched in heating condition in a case where two or more types of sheets are used in a single printing operation. That is, the second embodiment is smaller in the frequency with which the fixing device 15 is changed in heating condition. Thus, the second mode is shorter in the length of time the printer 100 is made to wait to change the fixing device 15 in heating condition than the first mode.

That is, the second mode is such an operational mode that is advantageous in terms of productivity.

On the other hand, the second mode is greater in the difference in image gloss among various sheet types, than the first mode. That is, the second mode is such an operational mode that is inferior in image quality compared to the first mode.

By the way, the "mixed mounting of sheets P" means the following situation. For example, when an image forming apparatus is used as a printer, it may be used for an image forming operation in which two or more types of sheets P are selected as recording mediums in a single image formation job (printing job), and the job is carried out while switching the recording medium among the selected types of sheets, or an image forming operation in which two or more printing jobs which are different in sheet type are inputted, and the two or more printing jobs have to be consecutively carried out. Furthermore, when an image forming apparatus is used as a copying machine, it may be used for an image forming operation in which two or more image formation jobs (copying jobs) which are different in sheet type are requested, and the jobs are to be consecutively carried out.

[First Mode]

Next, the first mode is described in greater detail regarding its temperature setting. FIG. 5A is a drawing which shows the relationship among the sheet type, basis weight range, and heating condition, in the first mode. FIG. 5B is a drawing which shows the relationship among the sheet type, representative value of basis weight range, and heating condition in the second mode.

In the first mode, the heating temperature for the fixing device 15 is set so that it becomes optimum for each of various sheets of paper, in terms of type, basis weight, and heating condition, according which sheets P are classified. For example, it is assumed that the cassettes 101-103 contain sheets of ordinary paper, which are 80 g/m$^2$ in basis weight; the cassette 104 contains sheets of ordinary paper, which are 200 g/m$^2$ in basis weight; and the cassette 105 contains sheets of coated paper, which are 90 g/m$^2$ in basis weight. In such a case, in the first mode, in the case of an image formation job which uses the cassettes 101-103, the heating temperature for the fixing device 15 is sent to 155° C. (first temperature), as shown in FIGS. 5A and 5B. In the case of an image formation job which uses the cassette 104, the heating temperature for the fixing device 15 is set to 175° C. (second temperature). In the case of an image formation job which uses the cassette 105, the heating temperature for the fixing device 15 is sent to 145° C.

In a case where these jobs are consecutively done in the listed order, the first setting section 193 changes the fixation roller 151 in heating temperature immediately after the inputting of the image formation jobs into the control circuit 19 through the control panel 20, or the like. Therefore, there occurs a waiting period between the inputting of the image formation jobs and the starting of the first image formation job. Further, for example, in the case of an image formation job which uses both the cassettes 101 and 104, each time the image forming apparatus is switched in the cassette used for image formation, the image formation is interrupted to carry out an operation for changing the fixation roller 151 in heating temperature. Also in this case, the waiting period occurs.

[Second Mode]

Next, the second mode is described in detail about its temperature setting. FIG. 6A is a drawing which shows the relationship among the sheet types, basis weight ranges of recording medium, and heating conditions in the second mode in this embodiment. FIG. 6B is a drawing which shows the relationship among the sheet types, representative values for basis weight ranges, and heating conditions, in the second mode. In the second mode, the heating temperature for the fixing device 15 is set so that it becomes optimal for each of the combinations of sheet type and representative value for basis weight range. Further, as long as the image formation job remains the same in sheet type and is not increased in basis weight of sheet, the fixing device 15 may be kept the same in heating temperature. Therefore, FIGS. 6A and 6B, which is for the second mode, is set up so that more types of sheets can be heated at the same temperature by the fixing device 15 than in the first mode.

That is, the second mode is provided with two or more heating conditions so that the heating condition can be selected according to the type of the sheets used for image formation. That is, the heating condition can be manually set with the use of the selecting section 21 as a selecting means with which the control panel 20 is provided. Referring to FIGS. 6A and 6B, in the case of this embodiment, the second mode is provided with four heating modes (heating conditions), that is, a standard mode, a cardstock priority mode, a thin paper priority mode, and a thinnest paper priority mode. That is, it is provided with such heating modes that are specified for cardstock and thin papers, in addition to the standard mode which is wider in the temperature range in which image formation is possible under the relatively common heating condition (heating temperature). Also in the case of this embodiment, in a case where two or more heating temperatures which are commonly usable for all the sheets in the cassettes 101-105, the heating temperature for the fixing device 15 is set to the lowest heating temperature among the common heating temperatures.

For example, it is assumed here that the cassettes 101-103 contain sheets (first sheets) of ordinary paper which are 80 g/m$^2$ in basis weight; the cassette 104 contains sheets of ordinary paper (second sheets) which are 200 g/m$^2$ in basis weight; and the cassette 105 contains sheets (second sheets) of coated paper which are 90 g/m$^2$. In a case where an image formation job which uses these cassettes 101-103 is carried out in the second mode, the heating mode is set to the thinnest sheet priority mode, and the heating temperature for the fixation roller 151 is set to 155° C. (third temperature).

Further, also in the case of an image formation job which uses the cassette 104 (second cassette) and in a case of an image formation job which uses the cassette 105 (second cassette), the thinnest sheet priority mode is selected, and the heating temperature for the fixation roller 151 is set to 155° C. (third temperature).

In a case where these printing jobs are consecutively carried out in the listed order, the control circuit 19 makes the printing jobs the same in the heating temperature for the fixation roller 151. Thus, the operation for interrupting the image formation to change the temperature of the fixing device 15 to such a temperature that is common to the sheets P in cassettes 104 and 105 is not required, and therefore, no waiting period occurs.

[Heating Mode Selection Sequence]

Figure 7:
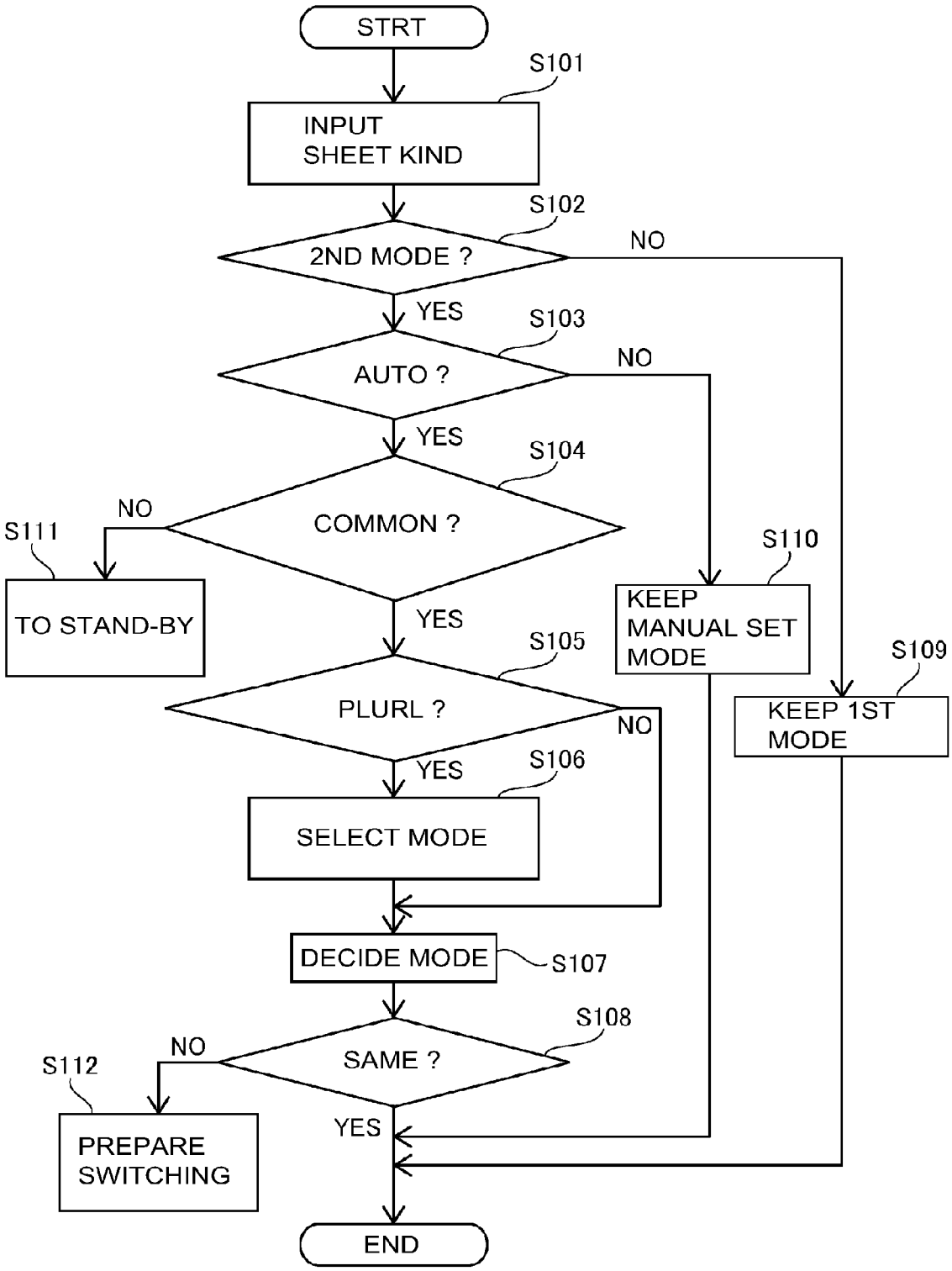
FIG. 7 is a flowchart of the heating mode selection sequence in the preferred embodiment.

Next, referring to FIG. 7, the heating mode selection sequence of the printer 100 is described. FIG. 7 is a flowchart of the heating mode selection sequence of the printer 100. By the way, in the following description of this sequence, it is presumed that all the cassettes have been made usable by a user through the selecting section 21. As the types of the sheets in the five cassettes are inputted by a user through the control panel 20 or external interface 22 (S101), the control circuit 19 determines whether or not the image forming apparatus is in the second mode (S102). By the way, the timing with which the sheet type is inputted is while the image forming apparatus is kept on standby before the image formation jobs are inputted, while an image forming job is carried out (during image formation), while the image forming apparatus is prepared (warmed up) for image formation, etc., as will be described later with reference to FIG. 9.

In a case where the operational mode is the first mode (No in S102), the control circuit 19 keeps the image forming apparatus in the first mode, and ends operational mode selection sequence (S109). That is, in a case where the control circuit 19 determines that the operation mode has been switched to the first mode by the switching section 192, the control circuit 19 keeps the image forming apparatus in the first mode, and operates the image forming apparatus in the first mode with the use of the first setting section 193. On the other hand, in a case where the operational mode is the second mode, that is, the operational mode has been switched to the second mode by the switching section 192 (Yes in S102), the control circuit 19 determines whether or not the image forming apparatus has been set so that the heating mode is automatically set by the second setting section 194 (S103). In a case where the image forming apparatus has been set so that the heating mode is to be manually set (No in Step 103), the control circuit 19 keeps the image forming apparatus in the manual setting mode, and ends the operational mode selection sequence (S110).

On the other hand, in a case where the control circuit 19 determines that the printer 100 has been set so that the heating mode is automatically set (Yes in S103), the control circuit 19 confirms the settings for all the cassettes in the printer 100. Then, the control circuit determines whether or not there is a heating mode which can satisfy all the sheets in all the cassettes (S104). Here, there are situations that make it impossible to use the same heating mode for all the sheets P in the cassettes, because the sheets P in the cassettes are rather large in the basis weight (No in S104), or the like reason. In such a case, the control circuit 19 moves to a step in which it finds the optimal heating mode, as soon as it determines the types of the sheets to be used for the image formation job after the inputting of the job (S111). This step in which the optimal heating mode is selected will be described later.

In comparison, in a case where all the sheets P in all the cassettes can be acceptably processed in a common heating mode (Yes in S104), the control circuit 19 determines whether or not there are two or more heating mode candidates, with the use of the second setting section 194 (S105). If there is only one heating mode candidate (No in S105), the control circuit 19 selects this heating mode candidate as the heating mode (S107). On the other hand, if there are two or more heating mode candidates (Yes in S105), the control circuit 19 finds the heating mode which is lowest in heating temperature for the fixation roller 151 (S106), and selects this heating mode (S107). Next, the control circuit 19 determines whether or not the selected heating mode is the same as the current heating mode (S108). If the selected mode is the same as the current one (Yes in S108). The control circuit 19 ends the heating mode selection sequence. On the other hand, if the selected heating mode is different from the current one (No in S108), the control circuit 19 moves to a step in which the image forming apparatus is prepared for the heating mode switching process, which will be described later.

[Heating Mode Selection Period 1 (Waiting Period 1)]

Figure 8:
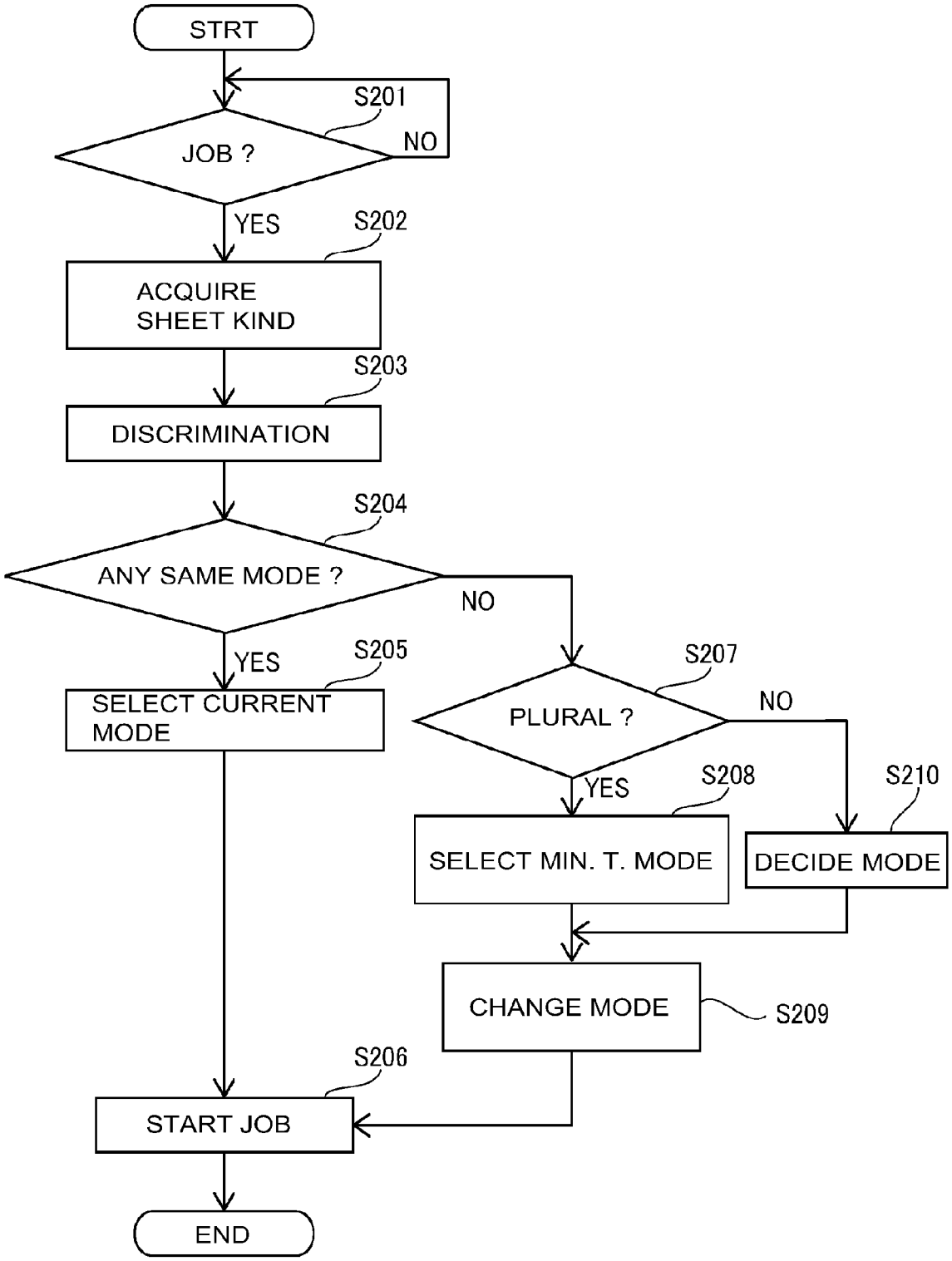
FIG. 8 is a flowchart of the control sequence in the heating mode selection period (standby period) in the preferred embodiment.

Next, referring to FIG. 8, the heating mode selection period 1 is described. FIG. 8 is a flowchart of the operational sequence which is carried out by the control circuit 19 during the heating mode selection period. The heating mode selection period 1 means a period which is right after the inputting of the sheet type of each cassette, and in which the control circuit 19 cannot find a heating condition which can satisfy all the sheets P in all the cassettes (there is third sheet type). In this situation, the control circuit 19 sets the heating condition for the fixing device 15 after the inputting of the image formation jobs. This heating condition is such a heating condition that minimizes the number of times the image forming operations has to be switched in heating condition. Next, this sequence is concretely described.

First, the control circuit 19 determines whether or not an image formation job (image formation jobs) has been inputted (S201). If it determines that the image formation job has been inputted, the control circuit 19 obtains the information regarding the types of the sheets P to be used for the image formation job (S202). That is, as an image formation job (jobs) is inputted, it becomes possible for the control circuit 19 to determine the types of the sheets P to be used for the image formation job. Therefore, the control circuit 19 reads out the information regarding the sheets P from the storing section 191. By the way, it is desired that until an image formation job is inputted, the fixing device 15 is heated with the use of the target temperature used for the immediately preceding job. In this case, the information regarding the target temperature used in the immediately preceding job has been stored in the storing section 191.

Then, the control circuit 19 selects the heating mode candidate which is the smallest in the number of times the fixing device 15 will be switched in heating condition, based on the information regarding the sheets P (S203). By the way, in this case, if there is a heating mode which is acceptable by all the sheets P in all the cassettes, this heating mode may be selected as the heating condition candidate. Next, the control circuit 19 determines whether or not there is a heating mode which is the same as the current heating mode for the fixing device 15 (S204). The current heating mode means the heating mode in which the fixing device 15 was when the information regarding the sheet type was inputted. That is, if it is during a waiting period, the control circuit 19 determines whether or not the selected heating mode is the same as the heating mode in which the fixing device 15 is in this waiting period. If it is while an image forming operation is carried out, or an image forming apparatus is being prepared for an image forming operation, it is during this period that the control circuit 19 determines whether or not the selected heating condition is the same as the heating condition in which the fixing device 15 is during this period. If the control circuit 19 finds a heating mode which is the same as the current heating mode (Yes in S204), the control circuit 19 selects this heating mode (S205). In this case, the fixing device 15 does not need to be switched in heating temperature. Therefore, the image formation job is started while the heating temperature for the fixation roller 151 is kept at the current level (S206).

On the other hand, if the control circuit 19 determines that there is no heating mode that coincides with the current heating mode, among the heating mode candidates (S204), the control circuit 19 determines whether or not there are two or more heating mode candidates (S207). If the control circuit 19 determines that there are two or more heating mode candidates (Yes in S207), it selects the heating mode candidate which is lowest in the heating temperature for the fixation roller 151 (S208). If the control circuit 19 determines that there is only one heating mode candidate (No in S207), it selects this heating mode candidate (S210). Next, the control circuit 19 carries out the operation for switching the fixing device 15 in heating mode from the current one to the newly selected heating mode (S209), and starts the image formation job (S206), and ends the heating mode selection sequence. Regarding the timing with which the fixing device 15 is switched in the heating mode by the control circuit 19, if it is while the image forming apparatus is on standby, or the image forming apparatus is being prepared for an image formation job, the switching is made during these periods. If it is while the image forming job is carried out, the switching is made before the next image formation job, which is inputted after the ending of the current job, begins to be carried out.

[Heating Mode Selection Period 2]

Figure 9:
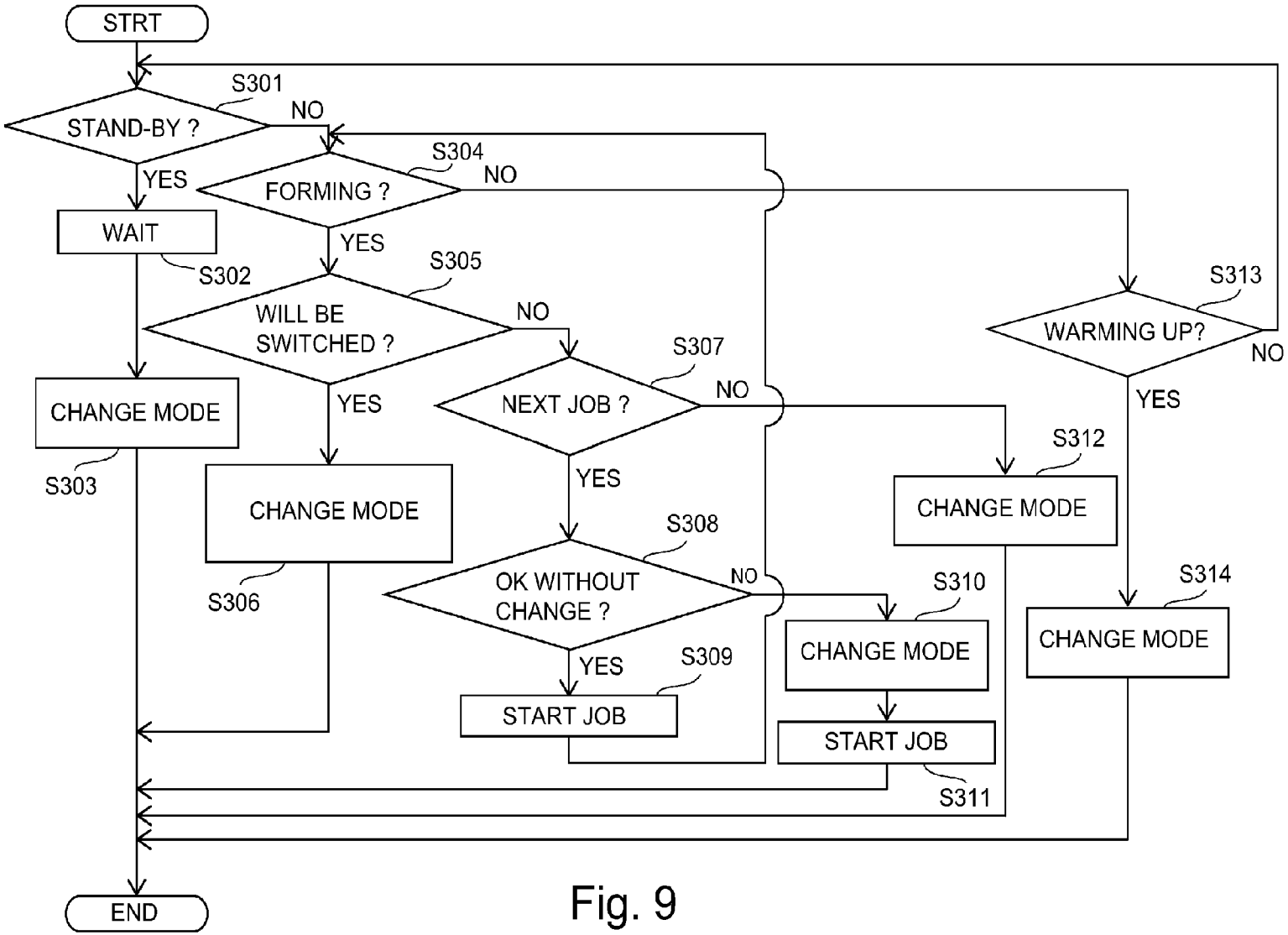
FIG. 9 is a flowchart of the control sequence in the preparatory period for heating mode switching in the preferred embodiment.

Next, referring to FIG. 9, the operation to be carried out while the printer 100 is prepared for the heating mode switching is described. FIG. 9 is a flowchart of the operational sequence carried out by the control circuit 19 during heating mode switching preparation state. The heating mode switching preparation state means a state in which the heating mode selected in S108 in FIG. 8 as described above is different from the current heating mode. Here, the current heating mode means the heating mode in which the fixing device 15 is in a period in which the image forming apparatus 100 is on standby, is carrying out an image formation job, or is being prepared for an image forming job. In this heating mode selection period, the control circuit 19 determines whether the image forming apparatus 100 is kept on standby, is forming images, or is being prepared for image formation, and changes the fixing device 15 in heating mode with such a timing that is proper for each situation. Next, the operation carried out in this heating mode selection period is more concretely described.

First, the control circuit 19 determines whether or not the printer 100 is kept on standby (S301). Here, "The printer 100 is kept on standby" means that the electric power source of the printer 100 is on, but the printer 100 is not performing an image formation job. As described above, a "image formation job" is an operation which comprises a pre-rotation period, an image formation period, sheet intervals, and a post-rotation period. Thus, a "waiting state" means a state of the printer 100 in which the electric power source of the printer 100 is on, but the operation comprising none of these periods is not being carried out.

If the printer 100 is kept on standby (Yes in S301), the control circuit 19 waits for a preset length of time (S302). If no image formation job is inputted in this period, the control circuit 19 changes the fixing device 15 in heating mode from the current one to the one selected in S107 in FIG. 7, and ends the heating mode switching preparation sequence (S303). That is, the control circuit 19 sets the heating condition (target temperature) for the fixing device 15 to such a heating condition (target temperature, 155° C., for example) that is common to the sheet types of all the sheets P in two or more cassettes (which in this embodiment are all the cassettes).

On the other hand, if the control circuit 19 determines in S301 that the printer 100 is not being kept on standby (No in S301), it determines whether or not the printer 100 is forming an image (S304). If it determines that the printer 100 is not forming an image (No in S304), it determines whether or not the printer 100 is in the warm-up period (S313). If it determines that the printer is not in the warm-up period (preparatory period) (No in S313), it returns to the first step in the heating mode switching preparation sequence, and restarts the sequence. On the other hand, if the control circuit 19 determines that the printer 100 is in the warm-up period (Yes in S313), it changes the fixing device 15 in heating mode from the current one to the one selected in S107 in FIG. 7 (S314), and ends the heating mode switching preparation sequence.

That is, this case is such a case that at least one of the cassettes is changed in sheet type after the inputting of the an image formation job, and the printer 100 is being warmed up (prepared) for the inputted image formation job. In other words, it is such a case that the sheets P in at least one of the cassettes are replaced with sheets P which are different in type from those in the cassette, and the type of the replacement sheets is inputted. In this case, the control circuit 19 changes the fixing device 15 in heating condition from the current one to a heating condition which is common to all the sheets P, including the sheets P of the new type, in all the cassettes, during the warm-up operation. By the way, if there is no heating condition that is common to all the sheets P, including the sheets P of the new type, the control circuit 19 moves from S104 to S111 in FIG. 7, and carries out the sequence shown in FIG. 8.

If the control circuit 19 determines in S304 that the printer 100 is forming an image (Yes in S304), it determines whether or not the image formation job which is being carried out requires the changes in the heating temperature for the fixation roller 151 (operation for switching heating condition) (S305). If the control circuit 19 determines that the job requires the changes in the heating temperature for the fixation roller 151 (Yes in S305), it changes the fixing device 15 in heating mode to the mode selected in S107 shown in FIG. 7, with the aforementioned heating condition changing timing (S306), and ends the heating mode switching preparation sequence.

That is, this case is such a case that the sheets P in at least one of the cassettes are replaced with sheets P which are different in type from those in the cassette, after the inputting of an image formation job, and the fixing device 15 is changed in heating condition while the inputted image forming job is being performed. In other words, it is such a case that the sheets P in at least one of the two or more cassettes are replaced with sheets P which are different in type from those in the cassette, and the new sheet type (different sheet type) is inputted, while the inputted image formation job is being carried out. That is, it is such a case that the fixing device 15 is changed in heating mode while the inputted image formation job is carried out.

As for examples of the situation in which the above described cases occur, there is such a situation that before the sheets P are changed, there is no heating condition that is common to all the sheets P in all of the two or more cassettes, and the fixing device 15 is changed in heating condition during an image formation job. That is, it is such a situation that because the sheets P are changed, a heating condition which is common to all the sheets P in all of two or more cassettes occurs, and therefore, the above described operation is carried out. That is, in a situation such as the above described one, the heating condition for the fixing device 15 is changed to such a condition that is common to all the sheets P including the new sheets P. By setting the heating condition for the fixing device 15 as described above, it is possible to set the heating condition for the fixing device 15 to a heating condition that is common to all the sheets in all the cassettes during the current image formation job, before the next image formation job (first image formation job) is inputted. Therefore, it is possible to prevent the waiting (idle) period which is attributable to the changing of the heating condition, from occurring before the next image forming job is started. By the way, if there is no heating condition that is common to all the sheets P including the replacement sheets P, the control circuit 19 moves from S104 to S111, shown in FIG. 7, and follows the sequence shown in FIG. 8.

If the control circuit 19 determines in S305 that the current image formation job does not require an operation for changing the heating condition (No in S305), the control circuit 19 determines whether or not the next job has been inputted (S307). If it determines that the next job has not been inputted (No in S307), the control circuit 19 carries out the heating mode switching operation with which it ends the on-going image forming job (as job is completed) (S312), and ends the heating mode switching preparation sequence. For example, the control circuit 19 carries out the heating mode switching operation during the post-rotation period.

If the next image formation job has been inputted (Yes in S307), the control circuit 19 determines whether or not the next image formation job can be done in the same heating mode as the current one (S308). That is, the control circuit 19 determines whether or not the heating mode selected in S107 in FIG. 7 is the same as the current one, and therefore, the next image formation job can be done without changing the heating condition. If it can be done (Yes in S308), the control circuit 19 does not change the fixing device 15 in heating condition. That is, it keeps the current heating temperature setting for the fixing device 15, and starts the image formation job (S309). Then, the control circuit 19 returns to S304, and restarts the heating mode switching preparation sequence.

If the control circuit 19 determines in S308 that the next image formation job cannot be done in the same heating mode as the one for the current one (No in S308), it changes the fixing device 15 in heating mode from the current one to the one selected in S107 shown in FIG. 7, before it starts the next image formation job (S310). Then, the control circuit 19 starts the image formation job (S311), and ends the heating mode switching preparation sequence.

That is, this case is such a case that after the inputting of the image formation job (second image formation job), the sheets P in at least one of the two or more cassette are replaced with sheets P which are different in type from those in the cassette, and the fixing device 15 is switched in heating condition in the next image formation job (first image formation job). In other words, it is such a case that during an image forming operation, the sheets P in at least one of the two or more cassettes are replaced with sheets P which are different in type from those in the cassette, and the type of the replacement sheets is inputted. That is, it is such a case that the on-going image formation job does not require the fixing device 15 to be switched in heating mode, and the next image formation job requires the fixing device 15 to be switched in heating mode.

As for an examples of the case in which situations such as the above described ones might occur, there is a case in which before the sheets P in at least one of the two or more cassettes are replaced with sheets P which are different in type from those in the cassette, there is no heating condition that is common to all the sheets P in all the cassettes, and the fixing device 15 is switched in heating mode between the on-going image formation job and the next image formation job. In this case, the above described operation is carried out as a heating condition which is common to the sheets P in all the cassettes occurs as the results of the sheet replacement. That is, in this case, during an operation for switching the fixing device 15 in heating condition, the heating condition for the fixing device 15 is set to the heating condition that is common to all the sheets P, including the replacement sheets P, in all the cassettes. By changing the fixing device 15 in heating condition as described above, it is possible to set the heating condition for the fixing device 15, to the common heating condition before the next image formation job (first image formation job) is inputted. Therefore, it is possible to prevent the occurrence of the waiting (idle) period which occurs if the heating condition is changed between the two image formation jobs which are to be consecutively carried out. By the way, if there is no heating condition that is common to all the sheets P, including the replacement sheets P, in all the cassettes, the control circuit 19 moves from S104 to S111 in FIG. 7, and starts the sequence in FIG. 8.

Concrete Example

An example of the above described heating condition switching preparation sequence is described. First, regarding the conditions under which the printer 100 is operated, it is assumed here that the printer 100 is in the second mode, the heating condition is automatically determined and set, and the cassettes 101-105 contain sheets P of ordinary paper which are 80 g/m$^2$ in basis weight. Further, the printer 100 is in the middle of an image formation job A which uses only sheets of ordinary paper which are 80 g/m$^2$ in basis weight, and an image formation job B which also uses only sheets P of ordinary paper which are 80 g/m$^2$ in basis weight has been already inputted. Further, the sheets P in the cassette 105 are replaced with sheets P of ordinary paper which are 250 g/m$^2$ in basis weight. In this case, the image formation job is being done, with the heating mode set to the thinnest paper priority mode, and the temperature of the fixation roller 151 set to 155° C.

Referring to FIG. 7, it is inputted that the sheets P placed in the cassette 105 are sheets P of ordinary paper which are 250 g/m$^2$ in basis weight (S101). Since the apparatus is in the second mode, the control circuit 19 selects Yes in S102. Further, the automatic detection mode is on, the control circuit 19 selects Yes in S103. Referring to FIGS. 6A and 6B, there is a mode which makes it possible to form images under a heating condition which is common to all the cassettes, the control circuit 19 selects Yes in S104. Since the heating mode candidates are the standard mode and thin paper priority mode, the control circuit 19 selects Yes in S105. Then, the control circuit 19 selects the thin paper priority mode which is the lowest in heating temperature (S106), and then, sets the thin paper priority mode as the new heating mode (S107). Since the new heating mode is the thinnest paper priority mode, the control circuit 19 selects No in S108, and moves to the heating mode switching preparation sequence (S112).

Next, referring to FIG. 9, since the printer 100 is forming an image, the control circuit 19 selects No in S301, and Yes in S304. The image forming job A, which is being done, uses only sheets P of ordinary paper which are 80 g/m$^2$. Therefore, the job A does not require the heating job switching operation. Thus, the control circuit 19 selects No in S305. Further, the next image formation job B has been inputted (on standby). Therefore, the control circuit 19 selects Yes in S307. The image formation job B also uses only ordinary paper which is 80 g/m$^2$. Therefore, it can be done in the current mode, that is, the thinnest paper priority mode. Therefore, the control circuit 19 selects Yes in S308. Then, in order to prioritize productivity, the control circuit 19 does not carry out the heating mode switching operation after the completion of the image formation job A. That is, it starts the image formation job B as soon as the image formation job is completed (S309). As the heating mode switching preparation sequence is started, the control circuit 19 returns to S304, and selects No in S305. Since there is no image formation job after the image formation job B, the control circuit 19 selects No in S307. Then, while the operation for ending the image formation job B is carried out after the completion of the image formation job B, the control circuit 19 does the heating mode switching operation as well (S312). Then, the control circuit 19 sets the heating mode to the thin paper priority mode, ending the heating mode switching operation.

As described above, in this embodiment, the heating mode will have been switched to the thin paper priority mode at the completion of the image formation job B. Thus, even if the next image formation job to be done uses the cassette 105, the image formation job can be done without switching the heating condition. Therefore, it is possible to prevent the occurrence of the waiting (idle) period which is attributable to the switching of the heating condition.

Effects of this Embodiment

In this embodiment, the fixing device 15 is heated while the printer 100 is kept on standby for the inputting of an image formation job. The temperature at which the fixing device 15 is heated during this standby period is set based on the information regarding the types of the sheets P in the cassettes. To describe in detail, the fixing device 15 is heated to, and kept at, a level (common temperature) at which the two or more types of the sheets P in the cassettes can be acceptably heated. Further, even if an image formation job is inputted, the fixing device 15 is not changed in heating temperature. That is, images are heated at the same temperature level. Therefore, it is possible to save the time which will have been used for changing the fixing device 15 in temperature. Thus, it is possible to improve the printer 100 in productivity. That is, it is possible to eliminate the time which a user will have to spend for changing the fixing device 15 in heating condition. That is, this embodiment improves a printer in usability.

Further, in this embodiment, the fixing device 15 is changed in heating mode while the printer 100 is kept on standby for the reception of an image formation command signal, as will be evident from the preceding description of the heating mode switching sequences. Therefore, it is possible to change the fixing device 15 in heating mode while prioritizing the image formation jobs according to the concerns of the user. Thus, it is possible to substantially reduce the length of time necessary for changing the fixing device 15 in heating condition, compared to the case in which each time an image formation job is inputted, the information regarding the sheets P used in the inputted job is obtained, and then, a heating mode for the job is determined.

Further, in a case where there are two more heating condition candidates which are common to the types of the sheets P in two or more cassettes, the heating temperature for the fixing device 15 is set to the heating condition which is the lowest in heating temperature. Therefore, it is possible to reduce electric power consumption. By the way, in a case where two or more image formation jobs are consecutively done, even if the on-going job is being done at a high temperature, the temperature for the next job is automatically set as low as possible.

For example, in a case where two or more image formation jobs are consecutively done, if the high temperature used for the current image formation job is used for the next job, a substantial amount of electric power is consumed to maintain the temperature of the fixing device 15 at the high temperature. Further, the temperature of the image forming apparatus itself unnecessarily increases. Thus, it is required to more frequently activate cooling devices, and the like. Therefore, a substantial amount of electric power is consumed to drive the cooling devices, etc. In comparison, in this embodiment, the heating temperature for the fixing device 15 is kept as low as possible. Therefore, it is possible to minimize the fixing device 15 in the amount of electric power consumption.

Miscellaneous Embodiments

In the case of the above-described embodiment, the heating condition for the fixing device 15 is selected based on the information regarding the sheets P of paper in all the cassettes with which the printer 100 is provided. That is, the heating condition for the fixing device 15 is set to such a heating condition that is common to all the types of all the sheets P in all the cassettes. However, the method for selecting the heating condition for the fixing device 15 does not need to be limited to the above-described one. For example, the heating condition for the fixing device 15, which is for the waiting period, may be selected based on the information regarding the types of the sheets P in some (two or more) of all the cassettes with which the printer 100 is provided. That is, the heating condition for the fixing device 15, which is for the period in which the fixing device 15 is idled, may be selected based on the types of the sheets P in specific two or more cassettes. More concretely, the cassette used for the second mode may be selected by a user (operator). By the way, the cassette to be used for the second mode is selected by a user with the use of the selecting section of the control panel. The control circuit 19 is enabled to select cassettes 101 and 102, for example, among all the cassettes 101-105. Then, the control circuit 19 selects the heating condition under which the fixing device 15 is to be heated while the fixing device 15 is idled, based on the types of the sheets P in the cassettes 101 and 102. That is, the control circuit 19 sets the heating condition for the fixing device 15 to such a heating condition that is common to all the types of all the sheets P in cassettes 101 and 102. This kind of control is used in a case where one, for example, of the cassettes contains sheets P of paper which are low in frequency of usage. As described above, by not using the cassette which is low in the frequency of usage for the temperature control of the fixing device 15 while the printer 100 is kept on standby, it is possible to more effectively make a decision regarding the temperature. That is, because the cassette which is low in the frequency of usage is eliminated from those used for selecting the heating condition candidates, it becomes easier to determine a common heating condition.

Further, in the case of the above described embodiment, the heating temperature for the fixation roller 151 was the same as the heating condition for the fixing device 15. However, the choice of the heating condition for the fixing device 15 is not limited to this. For example, sheets P may be heated based on sheet type, by controlling the temperature of the pressure roller 152. However, from the standpoint of excellence in image quality, it is preferable to control the temperature of the fixation roller 151 which is greater in terms of the ratio of contribution to the heating of sheets P than the pressure roller 152.

Further, the amount by which heat is applied to each sheet P may be controlled by controlling the speed with which the sheet P is conveyed. However, from the standpoint of stability in productivity, it is preferable to control the temperature of the fixation roller 151.

Further, in the case of the above described embodiment, if the printer 100 is in the second mode, and the control circuit 19 determines that there are two or more common heating temperatures (heating conditions), the control circuit 19 sets the lowest temperature of the two or more temperatures as the target temperature. However, the control circuit 19 may use a controlling method which is different from the one in the above described embodiment. For example, if there are two or more common heating temperature candidates (heating condition candidates), the heating temperature candidate which is higher in frequency of usage based on the history of previous usage may be set as the target temperature. To describe in detail, even if the heating mode in the standard mode is the highest in the frequency of usage based on the history of the previous usage of the image forming apparatus, and the standard mode is among the heating conditions which are common to two or more types of sheets P used for a job, the control circuit 19 may be set to the heating temperature for the standard mode as the target temperature. Further, the heating modes may be prioritized in advance, so that in a case where there are two or more common heating temperatures (heating conditions), the heating modes are selected in the order of priority.

Further, the contents of the control carried out during the standby period does not need to be limited to those in the first embodiment. For example, in the second mode, the control circuit 19 may alter the contents of control, based on whether or not the sheets P in the cassettes 101-105 can be heated at a temperature which is common to all the sheets P in all the cassettes. To describe in detail, in a case where the control circuit 19 cannot heat the sheets P in the cassettes 101-105 at a common temperature (case in which there are two or more heating conditions), the control circuit 19 controls as follows. That is, the control circuit 19 selects the target temperature (heating condition) based on the types of the sheets P used in the immediately preceding image formation job. By the way, in a case where two or more heating temperatures were used in the immediately preceding image formation job, the control circuit 19 sets the target temperature according to the type of the last sheet P used in the preceding image formation job. Then, during the standby period, the control circuit 19 controls the fixing device 15 so that the temperature of the fixation roller 151 remains stable at the target temperature. On the other hand, if the control circuit 19 determines that the sheets P in the cassettes 101-105 can be acceptably heated at a common heating temperature (case where there are two or more heating conditions), the control circuit 19 selects the common heating temperature as the target temperature. Then, in the standby mode, the control circuit 19 controls the temperature of the fixation roller 151 so that it remains stable at the target temperature.

While the invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-105127 filed on May 21, 2014, which is hereby incorporated by reference herein in its entirety.

What is claimed is:

1. An image forming apparatus comprising:

a first accommodating portion configured to accommodate at least one sheet;

a second accommodating portion configured to accommodate at least one sheet of a type different from the sheet accommodated in said first accommodating portion;

an image forming portion configured to form a toner image on the sheet fed from one of said first and second accommodating portions in response to an image formation instruction in an image formation mode;

a fixing portion configured to fix the toner image formed on the sheets by said image forming portion;

an acquiring portion configured to acquire information corresponding to the type of sheet accommodated in each of said first and second accommodating portions;

a first controller configured to control the temperature of said fixing portion in the image formation mode so as to maintain at a target temperature in the image formation mode which is set based on the type of the sheet, acquired by said acquiring portion, used in the image formation mode; and a second controller configured to control an operation of said fixing portion in a plurality of stand-by modes waiting for the image formation instruction so as to maintain at a target temperature in the stand-by modes, wherein the plurality of stand-by modes include a first stand-by mode in which the target temperature in the first stand-by mode is variably set based on the type of the sheet used in a last image formation mode, and a second stand-by mode in which the target temperature in the second stand-by mode is commonly set based on the types of the sheets accommodated in said first and second accommodating portions.

2. An apparatus according to claim 1, further comprising an operating portion configured to receive an instruction by an operator, wherein said operating portion enables the operator to select one of the stand-by modes including the first stand-by mode and the second stand-by mode.

3. An apparatus according to claim 1, wherein said acquiring portion acquires the information corresponding to the basis weight of the sheet, as the type of the sheet, accommodated in each of said first and second accommodating portions.

4. An apparatus according to claim 1, further comprising a heater configured to heat said fixing portion and a detector configured to detect the temperature of said fixing portion, wherein said first and second controllers control electric energy supplied to said heater based on the output of said detector.

* * * * *